US005758631A

United States Patent [19]

Teraoka

[11] Patent Number: 5,758,631

[45] Date of Patent: Jun. 2, 1998

[54] AIR-FUEL RATIO CONTROL APPARATUS FOR ENGINE

[75] Inventor: Masahiko Teraoka, Aichi-ken, Japan

[73] Assignee: Toyota Jidosha Kabushiki Kaisha, Toyota, Japan

[21] Appl. No.: 772,957

[22] Filed: Dec. 24, 1996

[30] Foreign Application Priority Data

Dec. 28, 1995 [JP] Japan ..... 7-342755

[51] Int. Cl.[6] ..... F02D 41/14; F02M 25/08

[52] U.S. Cl. ..... 123/674

[58] Field of Search ..... 123/674, 675

[56] References Cited

U.S. PATENT DOCUMENTS

| | | | |
|---|---|---|---|
| 4,961,412 | 10/1990 | Furuyama | 123/520 |
| 5,216,997 | 6/1993 | Osanai et al. | 123/698 |
| 5,237,979 | 8/1993 | Hyodo et al. | 123/520 |
| 5,406,927 | 4/1995 | Kato et al. | 123/674 |
| 5,423,307 | 6/1995 | Okawa et al. | 123/698 |
| 5,476,081 | 12/1995 | Okawa et al. | 123/478 |
| 5,520,160 | 5/1996 | Aota et al. | 123/675 |
| 5,546,917 | 8/1996 | Osainai et al. | 123/674 |

FOREIGN PATENT DOCUMENTS

| | | |
|---|---|---|
| 2-241943 | 9/1990 | Japan . |
| 2-248638 | 10/1990 | Japan . |
| 5-248315 | 10/1990 | Japan . |
| 5-321773 | 12/1993 | Japan . |
| 6-2591 | 1/1994 | Japan . |
| 7-305646 | 11/1995 | Japan . |

*Primary Examiner*—Willis R. Wolfe
*Assistant Examiner*—Hieu T. Vo
*Attorney, Agent, or Firm*—Kenyon & Kenyon

[57] ABSTRACT

Disclosed is an air-fuel ratio control apparatus, which controls the air-fuel ratio of a flammable air-fuel mixture to be supplied to an engine. This control apparatus controls the air-fuel ratio taking into account that fuel vapor produced in a fuel tank is added to the air-fuel mixture. The fuel vapor produced in the fuel tank is purged into the intake passage of the engine through a canister. An electronic control unit (ECU) controls the amount of fuel to be injected from each injector such that the air-fuel ratio of the air-fuel mixture matches a target air-fuel ratio. At the time the fuel vapor is purged, the ECU learns the density of fuel to be purged based on the detected value of an oxygen sensor. Based on this learned value, the ECU compensates the amount of fuel to be injected from each injector. When no fuel vapor flows to the canister from the fuel tank, the ECU specifies the learned value as being associated with the fuel vapor separated from the canister to be indirectly purged and compensates that learned value accordingly. When fuel vapor flows to the canister from the fuel tank, the ECU specifies the learned value as being associated with the fuel vapor that simply passes the canister to be directly purged and compensates that learned value accordingly.

22 Claims, 7 Drawing Sheets

AIR-FUEL RATIO CONTROL APPARATUS FOR ENGINE

BACKGROUND OF THE INVENTION

1. Field of the Invention

The present invention relates generally to an air-fuel ratio control apparatus for controlling the air-fuel ratio of a flammable mixture of air and fuel to be supplied to combustion chambers of an engine. More particularly, this invention relates to an air-fuel ratio control apparatus for controlling the engine air-fuel ratio, which adds fuel vapor generated in a fuel tank to the air-fuel mixture.

2. Description of the Related Art

There are air-fuel ratio control apparatuses that control the air-fuel ratio of a flammable mixture of air and fuel to be supplied to combustion chambers of an engine. In general, the air-fuel ratio demanded of an engine varies in accordance with the rotational speed of the engine (engine speed), the load state of the engine, the warm-up state of the engine and so forth. This type of control apparatus allows an incorporated computer to control a fuel supply apparatus to thereby adjust the amounts of fuel to be supplied to the combustion chambers in accordance with the demanded air-fuel ratio of the engine. That is, the computer adjusts the air-fuel ratio of the air-fuel mixture by compensating the amounts of fuel to be supplied to the combustion chambers from the fuel supply apparatus such that the actual air-fuel ratio detected by an associated sensor matches with the demanded air-fuel ratio. The adjustment of the air-fuel ratio allows various characteristics of the engine, such as the output characteristic, exhaust characteristic and drivability, to be optimized in accordance with various operational conditions of the engine.

Another apparatus to be mounted in a vehicle is a fuel vapor treating apparatus, which collects the fuel vapor generated in the fuel tank into the canister. This apparatus purges the collected fuel vapor to the intake passage from the canister as needed. The fuel purged into the intake passage is added to the actual air-fuel mixture to be supplied to the combustion chambers by the fuel supply apparatus.

The air-fuel ratio control should also be properly performed even in engines equipped with the fuel vapor treating apparatus. As the purged fuel is added to the actual air-fuel mixture to be supplied to the combustion chambers, therefore, the air-fuel ratio control should be executed in consideration of that purged fuel.

Japanese Unexamined Patent Publication No. Hei 2-248638 discloses one example of a control apparatus designed to control the air-fuel ratio in consideration of the fuel component purged into the intake passage. As shown in FIG. 8, this control apparatus causes individual injectors 72 provided on an engine 71 to inject fuel to the associated cylinders. An electronic control unit (ECU) 73 controls the individual injectors 72 such that the actual air-fuel ratio, which is detected by an oxygen sensor ($O_2$ sensor) 74, matches with the demanded air-fuel ratio (target air-fuel ratio), which changes in accordance with the running conditions of the engine 71. Accordingly, the amounts of fuel supplied to the individual cylinders are controlled to adjust the air-fuel ratio of the air-fuel mixture.

A canister 75 incorporates an adsorbent, comprised of activated carbon or the like, and has a communication hole 76 communicatable with the atmosphere. The canister 75 collects the fuel vapor produced in a fuel tank 77 via a vapor line 78 and causes the fuel vapor to be adsorbed by the adsorbent. A purge line 79 extending from the canister 75 is connected to an intake passage 80. An electromagnetic valve (VSV; vacuum switching valve) 81 provided in the purge line 79 selectively opens or closes this line 79 as needed. As the ECU 73 opens the VSV 81 when the engine 71 is running, the negative pressure produced in the intake passage 80 acts on the purge line 79. This negative pressure allows air to flow into the canister 75 from the communication hole 76. This air flow separates the fuel component, collected in the canister 75, from the adsorbent so that the fuel component is purged into the intake passage 80 via the purge line 79. At the time of purging, the ECU 73 learns the purge amount of the fuel component based on the detected value of the oxygen sensor 74. The ECU 73 calculates a compensation value based on the learned purge value to control the air-fuel ratio with the purged fuel component taken into consideration. In accordance with the calculated compensation value, the ECU 73 adjusts the amount of fuel injected from each injector 72.

The control apparatus disclosed in the above-mentioned Japanese publication should also reduce the deterioration of the adsorbent of the canister 75. One way to satisfy this need is to cause the fuel vapor, which flows into the canister 75 from the tank 77, to be directly purged into the intake passage 80 without temporary adsorption to the adsorbent when the engine 71 is running. In such direct purging, the amount of the fuel vapor flowing into the canister 75 from the tank 77 is nearly constant. The amount of air flowing into the canister 75 from the communication hole 76, as opposed to the amount of the fuel vapor, varies in accordance with the level of the negative pressure produced in the intake passage 80. The density of tho fuel component to be purged therefore becomes inversely proportional to the amount of air. Further, the value of that density changes in accordance with the amount of air flowing into the canister 75. The amount of fuel vapor, which is separated from the adsorbent and is indirectly purged into the intake passage 80 from the canister 75, is proportional to the amount of air flowing into the canister 75 from the communication hole 76. In this case of indirect purging, therefore, the density of fuel to be purged is constant regardless of the amount of air flowing into the canister 75 from the communication hole 76.

In the disclosed control apparatus, as apparent from the above, two fuel densities of different properties, such as those in the direct purging and indirect purging, are given with respect to a learned value associated with the amount of fuel to be purged into the intake passage 80. While the amount of fuel to be injected from each injector 72 at a certain point of time is compensated in accordance with the previously learned value, the density of fuel to be purged at the time of fuel injection may vary against the learned value, depending on the difference between the direct purging and indirect purging. This may result in inaccurate compensation of the amount of fuel to be injected from each injector 72, thus possibly reducing the precision of the air-fuel ratio control.

SUMMARY OF THE INVENTION

Accordingly, it is a primary objective of the present invention to provide an air-fuel ratio control apparatus, which is promised on the installation in an engine to which fuel vapor, produced in a fuel tank, is supplied via a canister to be added to the actual flammable air-fuel mixture, and which properly learns the density of the fuel to be supplied to the engine in accordance with the conditions to be able to control the air-fuel ratio of the air-fuel mixture at a high precision.

To achieve the foregoing and other objects and in accordance with the purpose of the present invention, an air-fuel ratio control apparatus for an engine is provided. The engine burns a flammable mixture of air, which flows through an air intake passage, and fuel, which is supplied from a fuel tank by a fuel supplying means. The apparatus comprises a canister, wherein the canister receives fuel vapor generated in the fuel tank and discharges the fuel vapor into the mixture, wherein the canister incorporates an absorbent and includes an air inlet, and wherein the absorbent is able to absorb the fuel vapor received by the canister, and wherein the air inlet allows air to flow into the canister when the fuel vapor is discharged from the canister, density detecting means for detecting density of a specific component in the mixture, and control means for controlling an amount of fuel supplied to the engine from the fuel supplying means to coincide an air-fuel ratio of the mixture with a target air-fuel ratio based on a operating condition of the engine and the detected density of the specific component. The apparatus further comprises flow detecting means for detecting fuel vapor flow into the canister from the fuel tank, a first learning means for learning the density of the fuel vapor added to the mixture as a first density related to fuel vapor that is temporarily absorbed to the absorbent and then is separated therefrom to be discharged from the canister when fuel vapor flow into the canister from the fuel tank is not detected, a second learning means for learning the density of the fuel vapor added to the mixture as a second density related to fuel vapor that is discharged from the canister without being absorbed to the absorbent when the fuel vapor flow into the canister from the fuel tank is detected, and correcting means for correcting the controlled fuel amount in accordance with a difference between the learned first density and the learned second density.

BRIEF DESCRIPTION OF THE DRAWINGS

Tho features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

An air-fuel ratio control apparatus according to one embodiment of the present invention as adapted for use in a vehicle will now be specifically described referring to the accompanying drawings.

Figure 1:
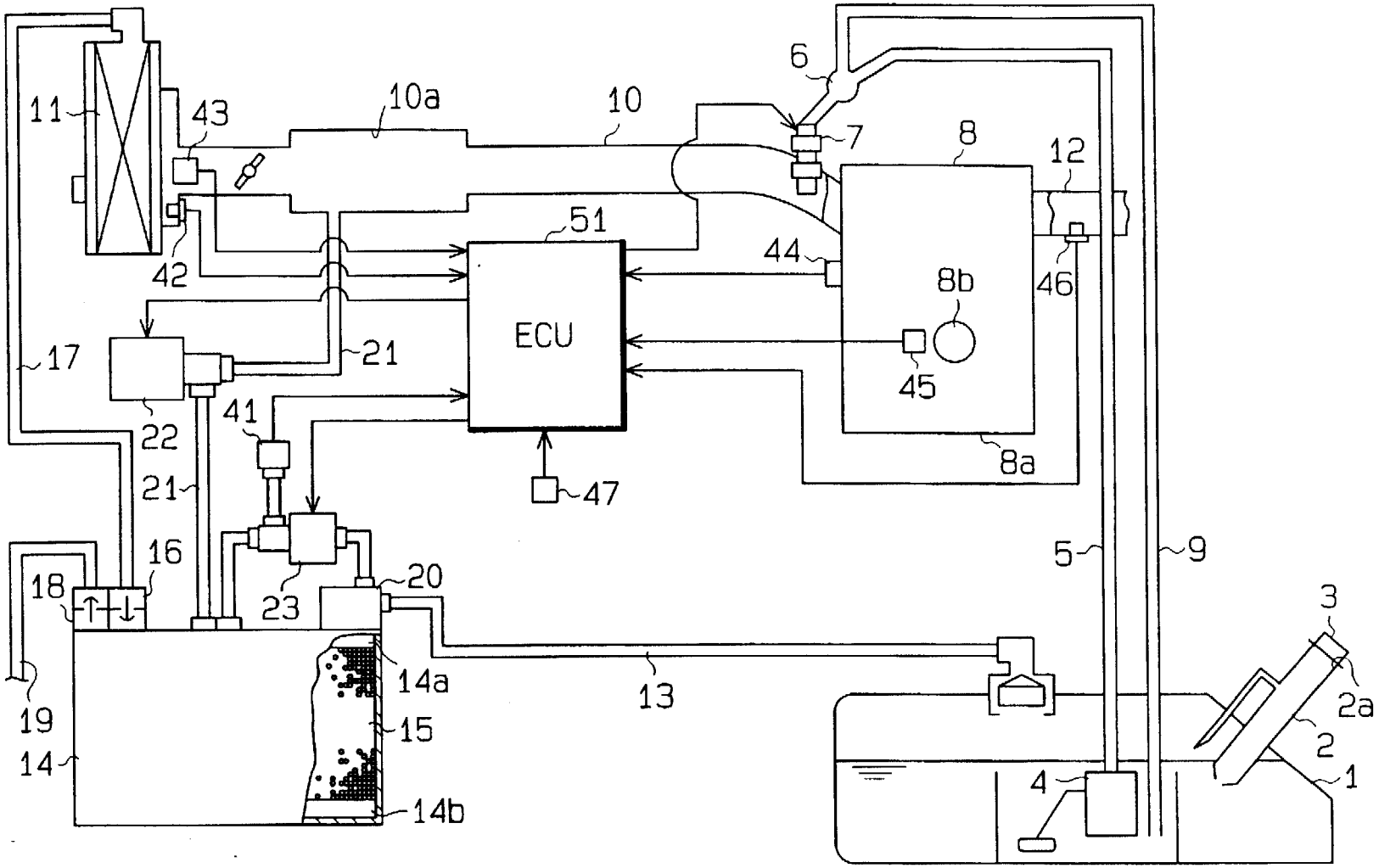
FIG. 1 is a schematic structural diagram illustrating an air-fuel ratio control apparatus for an engine equipped with a fuel vapor treating apparatus.

FIG. 1 shows the schematic structure of an air-fuel ratio control apparatus for an engine equipped with a fuel vapor treating apparatus. A gasoline engine system used in a vehicle has a fuel tank 1 in which fuel is reserved. The tank 1 includes a filler pipe 2 to refuel the tank 1. This pipe 2 has a filler hole 2*a* at the distal end into which a fuel nozzle (not shown) is inserted during refueling of the tank 1. The filler hole 2*a* is closed by a removable cap 3.

The fuel inside the tank 1 is drawn into a pump 4, incorporated in the tank 1, and discharged therefrom. A main line 5 extending from the pump 4 is connected to a delivery pipe 6. A plurality of injectors 7, provided in the pipe 6, are aligned with a plurality of cylinders (not shown) of an engine 8. A return line 9 extending from the pipe 6 is connected to the tank 1. The operation of the pump 4 causes the fuel discharged from the pump 4 to be sent via the main line 5 to the delivery pipe 6, which distributes the fuel to each injector 7. As each injector 7 is activated, the fuel is injected into associated each branch pipe of intake passage 10.

The intake passage 10 includes an air cleaner 11 and a surge tank 10*a*. Air is drawn into the intake passage 10 after being purified by the air cleaner 11. The fuel, injected from each injector 7, is mixed with the air, and this flammable air-fuel mixture is supplied to each cylinder of the engine 8 for combustion. The residual fuel that is not distributed to the injectors 7 is returned to the tank 1 via the return line 9. The exhaust gas produced during combustion is emitted outside from the cylinders of the engine 8 through an exhaust passage 12.

The fuel vapor treating apparatus of the preferred embodiment collects and treats vaporized fuel or fuel vapor produced in the tank 1 without releasing the fuel into the atmosphere. The fuel vapor treating apparatus has a canister 14 to collect fuel vapor flowing through the vapor line 13. The canister 14 is filled with an adsorbent 15 comprised of activated carbon or the like. The canister 14 includes an accommodating space, in which the adsorbent 15 is located, and opened spaces 14*a* and 14*b*, defined above and below the adsorbent 15.

A first control valve 16, which is provided in the canister 14, is a check valve. The control valve 16 opens when the internal pressure of the canister 14 becomes less than the atmospheric pressure. When opened, the control valve 16 allows atmospheric air (atmospheric pressure) to be drawn into the canister 14 while preventing the flow of gas in the reverse direction. An air pipe 17 extending from the control valve 16 is connected to the air cleaner 11. This structure enables atmospheric air, purified by the air cleaner 11, to be drawn into the canister 14. The canister 14 is also provided with a second control valve 18, which is also a check valve. The control valve 18 opens when the internal pressure of the canister 14 becomes greater than the atmospheric pressure. When opened, the control valve 18 allows gas (internal pressure) to be released from the canister 14 through an outlet pipe 19 while preventing the reversed flow of the gas.

A vapor control valve 20, provided in the canister 14, controls the flow rate of the fuel vapor flowing therethrough into the canister 14 from the tank 1. The control valve 20 opens in accordance with the difference between the internal pressure PT on the tank side including the vapor line 13 (hereafter referred to as "tank pressure") and the internal pressure PC on the canister side (hereafter referred to as "canister pressure"). When opened, the control valve 20 allows fuel vapor to flow into the canister 14 from the tank 1. In other words, the control valve 20 opens and allows fuel vapor to enter the canister 14 when the value of the canister pressure PC becomes approximately the same as the atmospheric pressure and is thus less than the tank pressure PT. The control valve 20 also allows gas to flow toward the tank 1 from the canister 14 when the canister pressure PC is higher than the tank pressure PT.

A purge line 21, extending form the canister 14, is connected to the surge tank 10*a*. The canister 14 collects only the fuel in the fuel vapor, introduced through the vapor line 13, by adsorption to the adsorbent 15, and discharges only the residual gas, from which fuel components have been extracted, into the atmosphere through the outlet pipe 19 when the control valve 18 is opened. When the engine 8 is running, the negative pressure produced in the intake passage 10 acts on the purge line 21. This causes the fuel collected in the canister 14 to be purged into the intake passage 10 through the purge line 21. A purge control valve 22, provided in the purge line 21, adjusts the flow rate of fuel passing through the line 21 when required by the engine 8. The control valve 22 is an electromagnetic valve that includes a casing and a valve body (neither shown). The valve body is moved by a supplied electric signal. The opening of the control valve 22 is duty controlled by a supplied duty signal.

This treating apparatus includes a pressure sensor 41, which detects the flow of fuel vapor to the canister 14 from the tank 1. The pressure sensor 41 is designed to be able to separately detect the tank pressure PT and the canister pressure PC with the vapor control valve 20 as the boundary. A three-way valve 23 having three ports is provided with the pressure sensor 41. The three-way valve 23 is an electromagnetic valve that switches the connection of two of the three ports based on a supplied electric signal. One of the ports of the three-way valve 23 is connected to the pressure sensor 41. The other two ports of the three-way valve 23 are respectively connected to the vapor line 13 on the tank side and to the canister 14 with the vapor control valve 20 as the boundary. By switching the connected pair of ports of the three-way valve 23 when needed, the pressure sensor 41 is selectively connected to either the vapor line 13 or the canister 14. This switching enables the pressure sensor 41 to selectively detect either the tank pressure PT or the canister pressure PC. In this embodiment, priority is given to the detection of the tank pressure PT over the detection of the canister pressure PC. Thus, the three-way valve 23 is designed so that the pressure sensor 41 is connected to the vapor line 13 when no electric signal is supplied to the three-way valve 23.

Various sensors 42, 43, 44, 45, 46 and 47 detect the running conditions of the engine 8 and the vehicle. The intake air temperature sensor 42, which is located near the air cleaner 11, detects the temperature of the air drawn into the intake passage 10, or the intake air temperature THA, and outputs a signal corresponding to the detected temperature value. The intake flow rate sensor 43, located near the air cleaner 11, detects the intake amount of the air drawn into the intake passage 10, or the intake flow rate Q, and outputs a signal corresponding to the detected flow rate. The coolant temperature sensor 44, provided on the engine 8, detects the temperature of the coolant flowing through an engine block 8*a*, or the coolant temperature THW, and outputs a signal corresponding to the detected temperature value. The engine speed sensor 45, provided in the engine 8, detects the rotational speed of a crankshaft 8*b* of the engine 8, or the engine speed NE, and outputs a signal corresponding to the detected speed. The oxygen sensor 46, provided in the exhaust passage 12, detects the oxygen concentration Ox of the exhaust gas passing through the exhaust passage 12, and outputs a signal corresponding to the detected value. This sensor 46 detects the concentration of the oxygen in the air-fuel mixture supplied to each cylinder of the engine 8 as a specific component. The vehicle speed sensor 47, provided in the vehicle, detects the vehicle speed SPD, and outputs a signal corresponding to the detected speed.

An electronic control unit (ECU) 51 receives the signal sent from the sensors 41–47. The ECU 51 executes the air-fuel ratio control for controlling the amount of fuel to be supplied from each injector 7 in such a way that the air-fuel ratio of the air-fuel mixture in the engine 8 is coincided with the target air-fuel ratio. The ECU 51 serves as the fuel vapor treating apparatus to control fuel purging. The ECU 51 controls the purge control valve 22 to purge the proper amount of fuel for the running conditions of the engine 8. That is, the ECU 51 sends a duty signal to the purge control valve 22 that is necessary to control the opening of the valve 22 in accordance with the required duty ratio DFG.

The fuel purged into the intake passage 10 from the canister 14 influences the air-fuel ratio of the air-fuel mixture in the engine 8. In this respect, the ECU 51 determines the opening of the purge control valve 22 in accordance with the running conditions of the engine 8. When the fuel vapor is supplied to the engine 8, the ECU 51 learns a value relating to the density of the fuel vapor, which is added to the air-fuel mixture, based on the value of the oxygen concentration Ox detected by the oxygen sensor 46. Generally, when the air-fuel ratio becomes larger, the concentration of CO or the like in the exhaust gas from the engine increases and the oxygen concentration Ox decreases. The ECU 51 therefore learns a purge density value FGPG based on the value of the oxygen concentration Ox in the exhaust gas, which is detected by the oxygen sensor 46. Based on this learned value FGPG, the ECU 51 determines the duty ratio DPG for the opening of the purge control valve 22, and it sends a duty signal in accordance with the value of the determined duty ratio DPG to the purge control valve 22. The ECU 51 compensates the amount of fuel to be adjusted by the air-fuel ratio control based on this learned value FGPG.

In this embodiment, the ECU 51 separately learns the purge density learned value FGPGC on the canister side and the purge density learned value FGPGT on the tank side. The purge density learned value FGPGC on the canister side means a learned value associated with the fuel vapor, which has been separated from the adsorbent 15 of the canister 14 after temporary adsorption and has flowed out of the canister 14. The purge density learned value FGPGT on the tank side means a learned value associated with the fuel vapor, which has flowed into the canister 14 from the fuel tank 1 and has flowed out of the canister 14 without being adsorbed to the adsorbent 15.

In accordance with the detected values from the sensors 41–47, the ECU 51 switches the connected ports of the three-way valve 23 and selectively reads either the value of the tank pressure PT or the canister pressure PC, both detected by the pressure sensor 41. The ECU 51 determines the existence or non-existence of the flow of fuel vapor from the tank 1 to the canister 14 based on the values of the tank pressure PT and the canister pressure PC. When the pressure sensor 41 detects the tank pressure PT, the ECU 51 determines if the detected value is equal to or greater than a predetermined value. When the is determination is affirmative, the ECU 51 determines that there is the flow of fuel vapor from the tank 1 to the canister 14.

Figure 2:
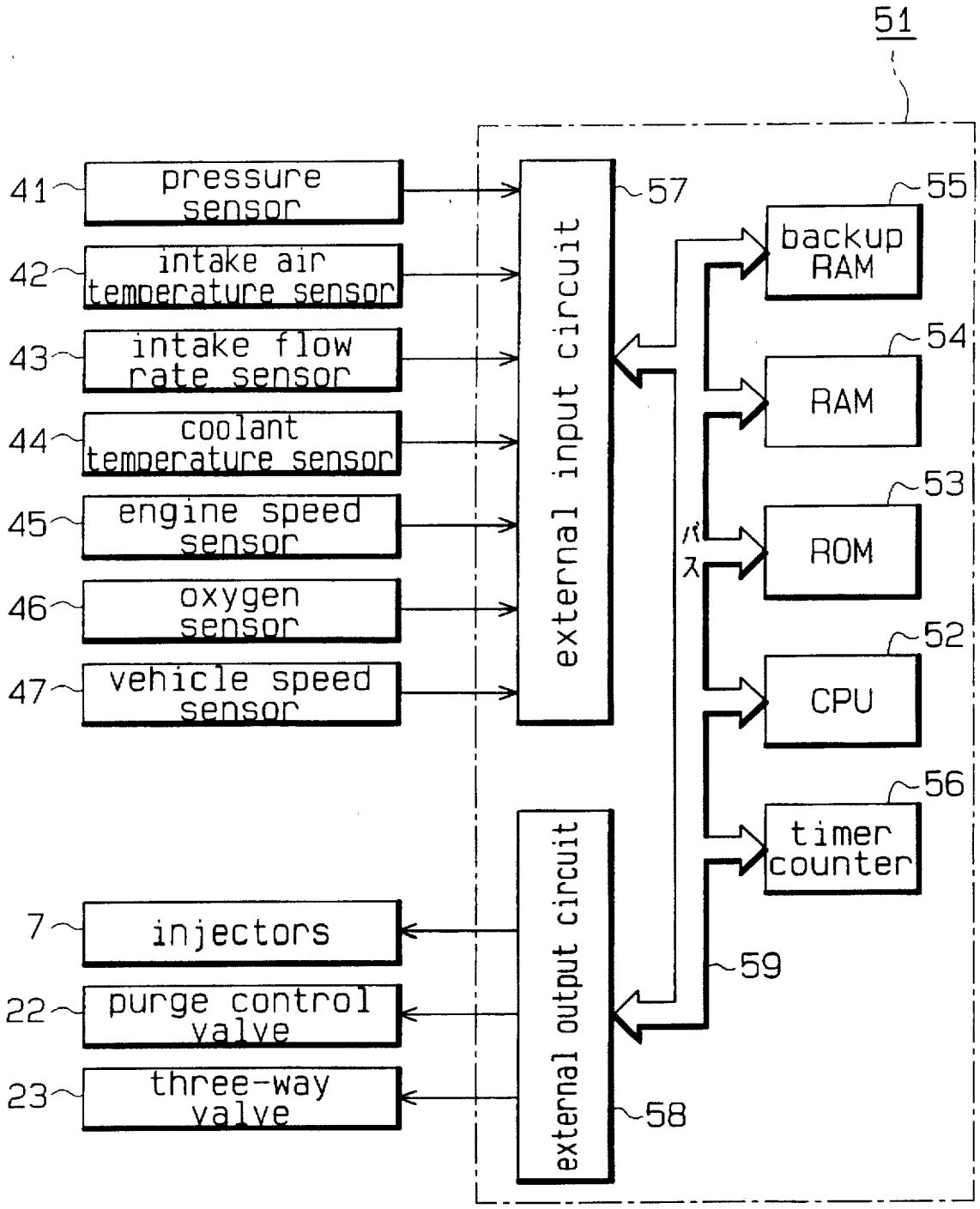
FIG. 2 is a block circuit diagram showing an electric control unit (ECU)

As shown in the block diagram of FIG. 2, the ECU 51 includes a central processing unit (CPU) 52, a read-only memory (ROM) 53, a random access memory (RAM) 54, a backup RAM 55, and a timer counter 56. In the ECU 51, an arithmetic logic circuit is formed by the CPU 52, the ROM 53, the RAM 54, the backup RAM 55, the timer counter 56, an external input circuit 57, an external output circuit 58, and a bus 59, which connects these components to one another. The ROM 53 prestores predetermined control programs associated with the air-fuel ratio and fuel purging or the like. The RAM 54 temporarily stores the results of the operations performed by the CPU 52. The backup RAM 55 prestores data. The timer counter 56 simultaneously executes a plurality of time measurements. The external input circuit 57 includes a buffer, a waveform shaping circuit, a hard filter (a circuit having an electric resistor and a capacitor), and an A/D (Analog to Digital) converter. The external output circuit 58 includes a drive circuit. The sensors 41–47 are connected to the external input circuit 57. The injectors 7, the purge control valve 22 and the three-way valve 23 are connected to the external output circuit 58.

The detected signals of the sensors 41–47, which are input via the external input circuit 57, are read by the CPU 52 as input values. The CPU 52 controls the injectors 7, the purge control valve 22 and the three-way valve 23 to perform air-fuel ratio control and fuel purging control based on the input values.

The control steps performed by the ECU 51 will be discussed below. The ROM 53 in the ECU 51 has control programs associated with various routines to be discussed below prestored therein.

Figure 3:
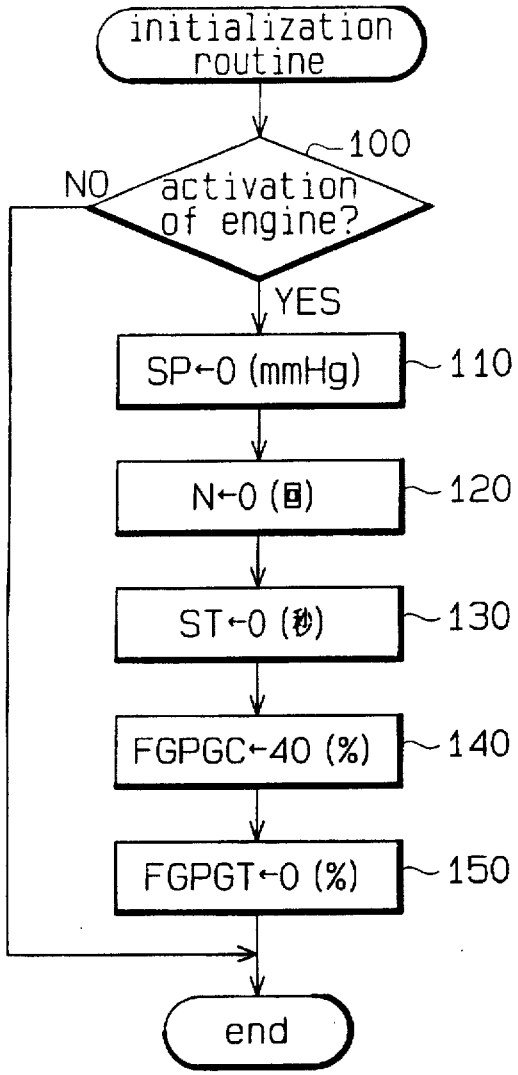
FIG. 3 is a flowchart illustrating an "initialization routine"

FIG. 3 presents the flowchart that illustrates an "initialization routine" to initialize various kinds of parameters associated with the learning of the purge density learned value FGPG.

In step 100, the ECU 51 determines based on the detected engine speed NE if the running condition of the engine 8 matches with the condition for the activation of the engine 8. When it is not the time for the activation of the engine 8, the ECU 51 terminates the subsequent processing. When it is the time for the activation of the engine 8, on the other hand, the ECU 51 executes the sequence of processes in steps 110 to 150 to initialize various parameters.

In step 110, the ECU 51 initializes a calculated value SP (unit: "mmHg") indicating an increase in the tank pressure PT to "0".

In step 120, the ECU 51 initializes a value N indicative of the number of times the current value of the tank pressure PT, which is periodically detected, becomes lower than the previous value to "0".

In step 130, the ECU 51 initializes a measured value ST for measuring a predetermined time (e.g., 16 msec) to "0".

In step 140, the ECU 51 initializes the purge density learned value FGPGC on the canister side (unit: "%") to "40".

In step 150, the ECU 51 initializes the purge density learned value FGPGT on tho tank side (unit: "%") to "0" and then terminates the subsequent processing.

Figure 5:
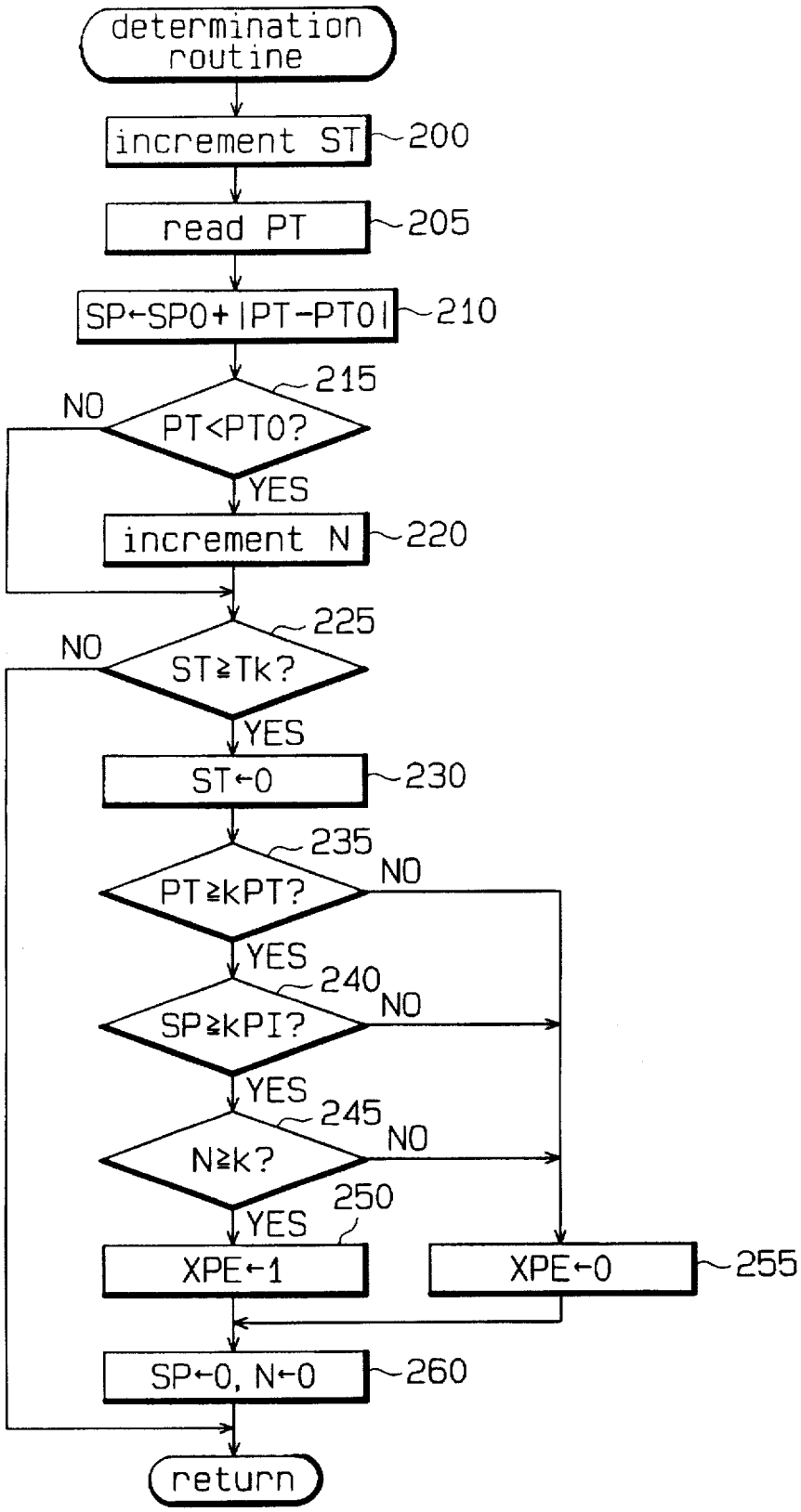
FIG. 5 is a flowchart illustrating a "determination routine"

FIG. 5 presents the flowchart which illustrates a "determination routine" for determining the generation of fuel vapor in the tank 1. The ECU 51 periodically executes this routine at predetermined interval.

In step 200, the ECU 51 increments the measured value ST.

In step 205, the ECU 51 reads the value of the tank pressure PT (after A/D conversion).

In step 210, the ECU 51 calculates the value SP indicating an increase in the tank pressure PT. Specifically, the ECU 51 calculates this value SP from the following equation (1):

$$SP=SPO+|PT-PTO| \quad (1)$$

where SPO indicates the previously calculated value and PTO indicates the value of the previously read tank pressure PT.

In step 215, the ECU 51 determines if the value of the currently read tank pressure FT is smaller than the value of the previously read tank pressure PTO. When the value of the current tank pressure PT is not smaller than the value of the previous tank pressure PTO, the ECU 51 proceeds to step 225. When the value of the current tank pressure PT is smaller than the value of the previous tank pressure PTO, the ECU 51 determines that the tank pressure PT has decreased and proceeds to step 220. In step 220, the ECU 51 increments the number N and goes to step 225.

In step 225, the ECU 51 determines if the measured value ST is equal to or greater then a predetermined reference value Tk. When the measured value ST is smaller than the reference value Tk, the ECU 51 temporarily terminates the processing. When the measured value ST is equal to or greater than the reference value Tk, the ECU 51 moves to step 230 to reset the measured value ST to "0".

In step 235, the ECU 51 determines if the value of the tank pressure PT is equal to or greater than a predetermined reference value kPT. The reference value kPT is the value that can open the vapor control valve 20 when the tank pressure PT becomes equal to or greater than this reference value kPT. When the value of the tank pressure PT is less than the reference value kPT in step 235, the ECU 51 determines that no fuel vapor is being produced in the tank 1 and proceeds to step 255. In step 255, the ECU 51 sets a generation flag XPE to "0". When the value of the tank pressure PT is equal to or greater than the reference value kFT, the ECU 51 determines that fuel vapor is being produced in the tank 1 and proceeds to step 240.

In step 240, the ECU 51 determines if the calculated value SP is equal to or greater than a predetermined kPI. When the calculated value SP is less than the reference value kPI, the ECU 51 determines that there is a small increase in the tank pressure PT and executes the process in step 255. When the calculated value SP is equal to or greater than the reference value kPI, the ECU 51 determines that there is a large increase in the tank pressure PT and proceeds to step 245.

In step 245, the ECU 51 determines if the decreasing number N of the tank pressure PT is equal to or larger than a predetermined reference value k. When the decreasing number N is less than the reference value k, the ECU 51 determines that the vapor control valve 20 has not been opened yet and executes the process in step 255. When the decreasing number N is equal to or larger than the reference value k, the ECU 51 determines that the vapor control valve 20 is open, permitting the fuel vapor produced in the tank 1 to flow into the canister 14 and goes to step 250. In step 250, the ECU 51 sets the generation flag XPE to "1".

In step 260, subsequent to step 250 or step 255, the ECU 51 resets the calculated value SP and the decreasing number N to "0"and then temporarily terminates the subsequent processing.

Figure 4:
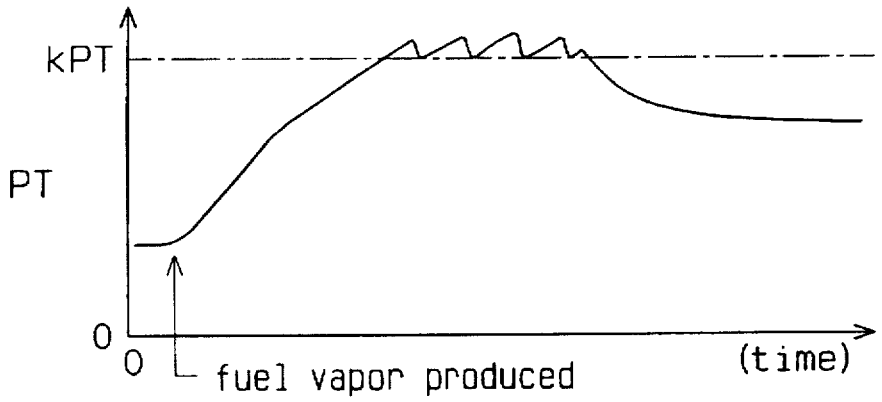
FIG. 4 is a time chart showing the behavior of the tank pressure.

FIG. 4 shows a change in the tank pressure PT after fuel vapor is produced in the tank 1. After the generation of fuel vapor, the tank pressure PT gradually rises to the reference value kPT. When the tank pressure PT reaches the reference value kPT, the vapor control valve 20 is opened. After the opening of the vapor control valve 20, the tank pressure PT oscillates with a predetermined amplitude range. When the tank pressure PT is equal to or greater than the reference value kPT and oscillates, it is understood that fuel vapor is flowing into the canister 14 from the tank 1. By making the determinations in steps 235, 240 and 245, therefore, the aforementioned change in the tank pressure PT can be checked. It is thus possible to detect the flow of fuel vapor toward the canister 14 from the tank 1.

Figure 6:
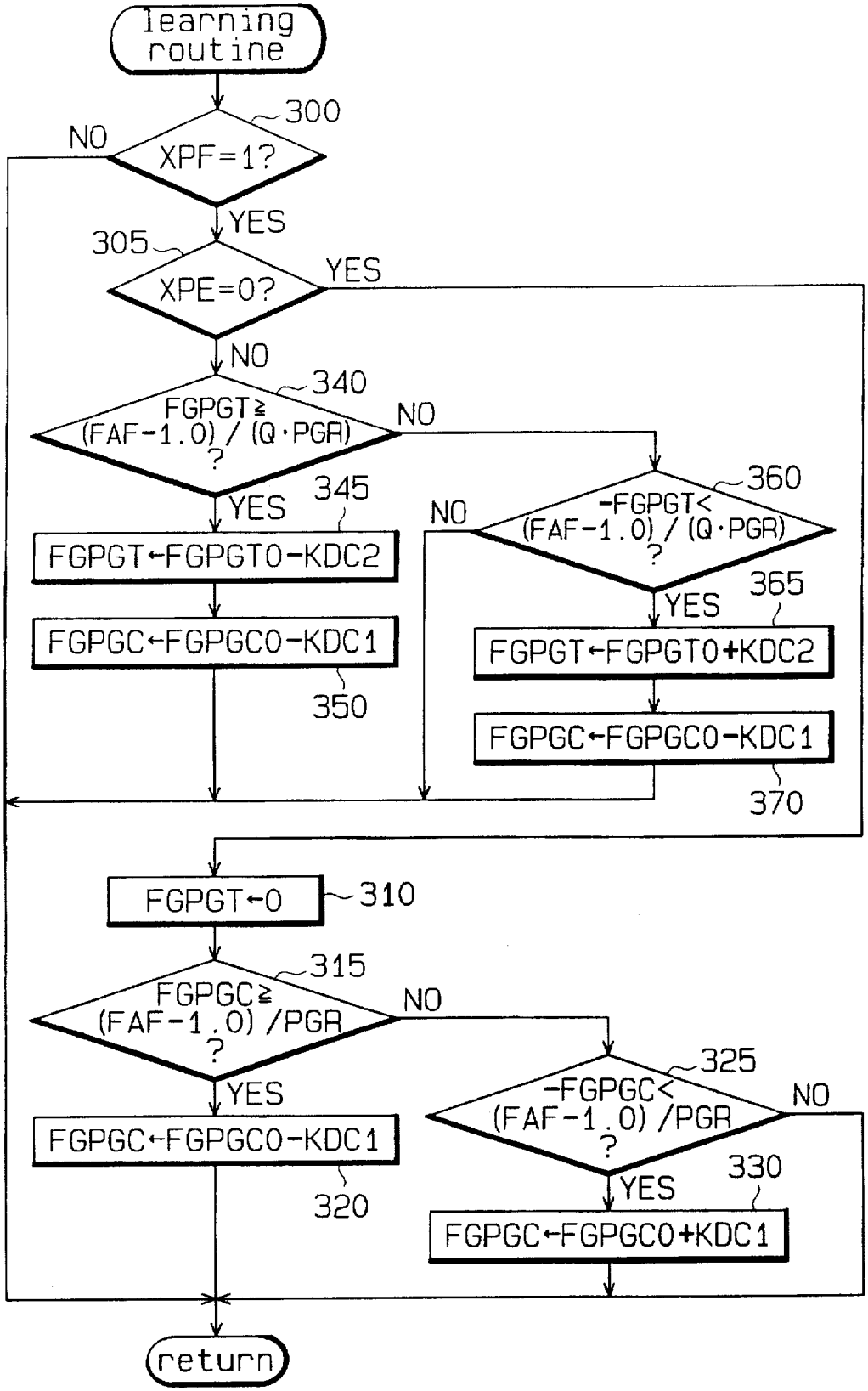
FIG. 6 is a flowchart illustrating a "learning routine"

FIG. 6 presents a flowchart that illustrates a "learning routine" for learning the purge density learned value FGPG. The ECU 51 periodically executes this routine at predetermined intervals.

In step 300, the ECU 51 determines if a learn flag XPF is "1". This flag XPF indicates "1" when the basic learning associated with the air-fuel ratio of the air-fuel mixture is in progress while no purging is performed. This flag XPF is set by another routine. When this learn flag XPF is "0", the ECU 51 determines that the basic learning is not carried out and temporarily terminates the subsequent processing. When this learn flag XPF is "1", the ECU 51 determines that the basic learning is in progress and proceeds to step 305.

In step 305, the ECU 51 determines if the generation flag XPE is "0". When the generation flag XPE is "0", no fuel vapor is flowing to tho canister 14 from the tank 1. Accordingly, the ECU 51 determines that a value (to be discussed later) to be learned in this "learning routine", is associated with the fuel vapor, which has been separated from the adsorbent 15 of the canister 14 after temporary adsorption and has flowed out of the canister 14, and moves to step 310.

In step 310, the ECU 51 resets the purge density learned value FGPGT on the tank side to "0" because the fuel vapor flowing out of the tank 1 does not raise any problem.

In step 315, the ECU 51 compares the purge density learned value FGPGC on the canister side with a deviation of an air-fuel ratio compensation value FAF per purge ratio PGR and determines if the former value is equal to or greater than the latter value. That is, the ECU 51 determines if the following inequality (2) is met.

$$FGPGC \geqq (FAF-1.0)/PGR \quad (2)$$

The air-fuel ratio compensation value FAF in the inequality (2) is used in the air-fuel ratio control. Specifically, based on the running conditions of the engine 8 and the detected value of the oxygen sensor 46, the ECU 51 controls the amount of fuel to be injected from each injector 7 in such a way that the air-fuel ratio of the air-fuel mixture becomes the desired target air-fuel ratio. The compensation value FAF is what is computed by the ECU 51 to correct the amount of fuel to be injected at this time. "FAF−1.0"means the "deviation" from the air-fuel ratio compensation value of "1.0". The ECU 51 calculates this compensation value FAF in accordance with the difference between the actual air-fuel ratio and the target air-fuel ratio. The purge ratio PGR means the amount of fuel vapor to be purged per unit time.

When the inequality (2) is satisfied in step 315, the ECU 51 proceeds to step 320 where the ECU 51 subtracts a predetermined value KDC1 from the previously calculated purge density learned value FGPGC0 and treats the resultant value as a new purge density learned value FGPGC. Then, the ECU 51 temporarily terminates the subsequent processing.

When the inequality (2) is not satisfied in step 315, the ECU 51 goes to step 325 where the ECU 51 compares the purge density learned value FGPGC on the canister side with the deviation of the air-fuel ratio compensation value FAF per purge ratio PGR to determine if the former value is less than the latter value. That is, the ECU 51 determines if the following inequality (3) is met.

$$-FGPGC < (FAF-1.0)/PGR \quad (3)$$

When the inequality (3) is satisfied in step 325, the ECU 51 adds the predetermined value KDC1 to the previously calculated purge density learned value FGPGC0 and treats the resultant value as a new purge density learned value FGPGC. Then, the ECU 51 temporarily terminates the subsequent processing. When the inequality (3) is not satisfied, the ECU 51 temporarily terminates the subsequent processing.

In this embodiment, the purge density learned value FGPGC on the canister side is defined as a value per the supply ratio of fuel vapor to be supplied to the engine 8 from the canister 14, or a value per the purge ratio.

When the generation flag XPE is "1" in step 305, there is the flow of fuel vapor to the canister 14 from the tank 1. The ECU 51 therefore specifies the learned value (to be discussed later), which is to be learned in this "learning routine", to two learned values and proceeds to step 340. One of the specified learned values is associated with the fuel vapor, which has been separated from the adsorbent 15 of the canister 14 after temporary adsorption and has flowed out of the canister 14, while the other specified learned value is associated with the fuel vapor, which has flowed out of the canister 14 without being adsorbed by the adsorbent 15.

In step 340, the ECU 51 compares the purge density learned value FGFGT on the tank side with the deviation of the air-fuel ratio compensation value FAF per purge flow rate (Q·PGR) to determine if the former value is equal to or greater than the latter value. That is, the ECU 51 determines if the following inequality (4) is met.

$$FGPGT \geqq (FAF-1.0)/(Q \cdot PGR) \quad (4)$$

The purge flow rate Q·PGR means the amount of fuel vapor to be purged per unit time.

When the inequality (4) is satisfied in step 340, the ECU 51 proceeds to step 345 where the ECU 51 subtracts a predetermined value KDC2 (KDC2≠KDC1) from the previously calculated purge density learned value FGPGT0 on the tank side and treats the resultant value as a new purge density learned value FGPGT. Further, in step 350, the ECU 51 subtracts the predetermined value KDC1 from the previously calculated purge density learned value FGPGC0 on the canister side, treating the resultant value as a new purge density learned value FGPGC, and then it temporarily terminates the subsequent processing.

When the inequality (4) is not satisfied in step 340, the ECU 51 goes to step 360 where the ECU 51 compares the purge density learned value FGPGT on the tans side with the deviation of the air-fuel ratio compensation value FAF per purge flow rate Q·PGR to determine if the former value is less than the latter value. That is, the ECU 51 determines if the following inequality (5) is met.

$$-FGPGT < (FAF-1.0)/(Q \cdot PGR) \quad (5)$$

When the inequality (5) is satisfied in step 360, the ECU 51 adds the predetermined value KDC2 to the previously calculated purge density learned value FGPGT0 and treats the resultant value as a new purge density learned value FGPGT in step 365. In the next step 370, the ECU 51 subtracts the predetermined value KDC1 from the previously calculated purge density learned value FGPGC0 on the canister side, treating the resultant value as a new purge density learned value FGPGC, and then it temporarily terminates the subsequent processing.

In this embodiment, the purge density learned value FGPGT on the tank side is defined as a value per the reciprocal of the fuel vapor amount to be supplied to the engine 8 from the canister 14. In this embodiment, the predetermined values KDC1 and KDC2, which are to be added to or subtracted from the purge density learned values FGPGC and FGPGT on the canister side and the tank side in steps 320, 330, 345, 350, 365 and 370, differ from each other.

Figure 7:
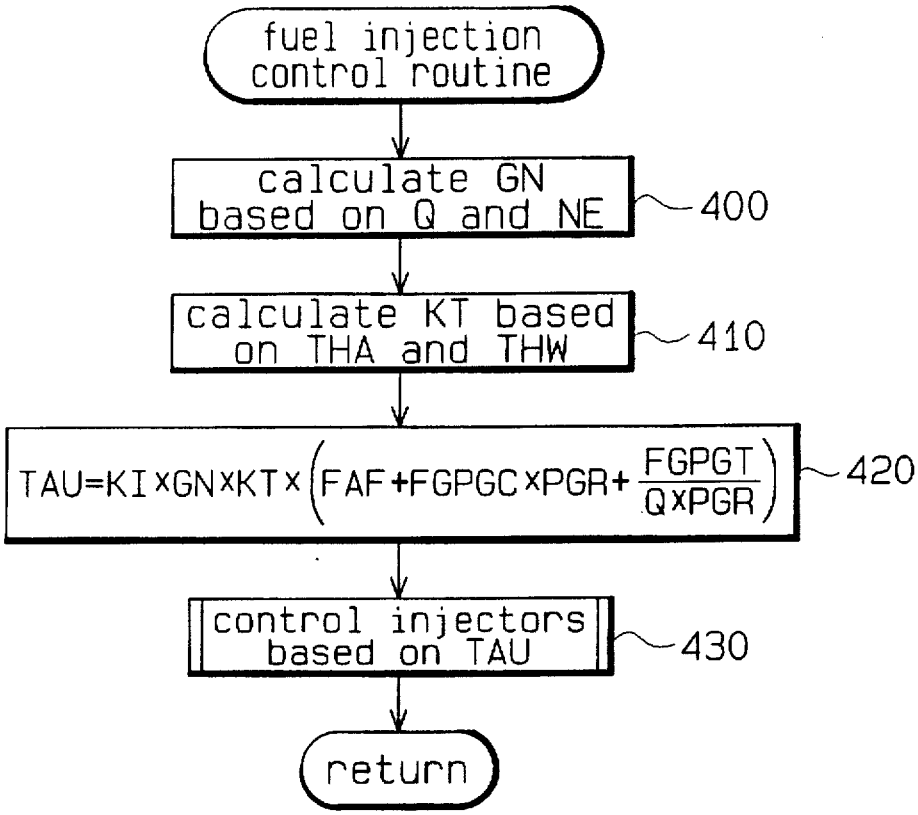
FIG. 7 is a flowchart illustrating a "fuel injection control routine"
Figure 8:
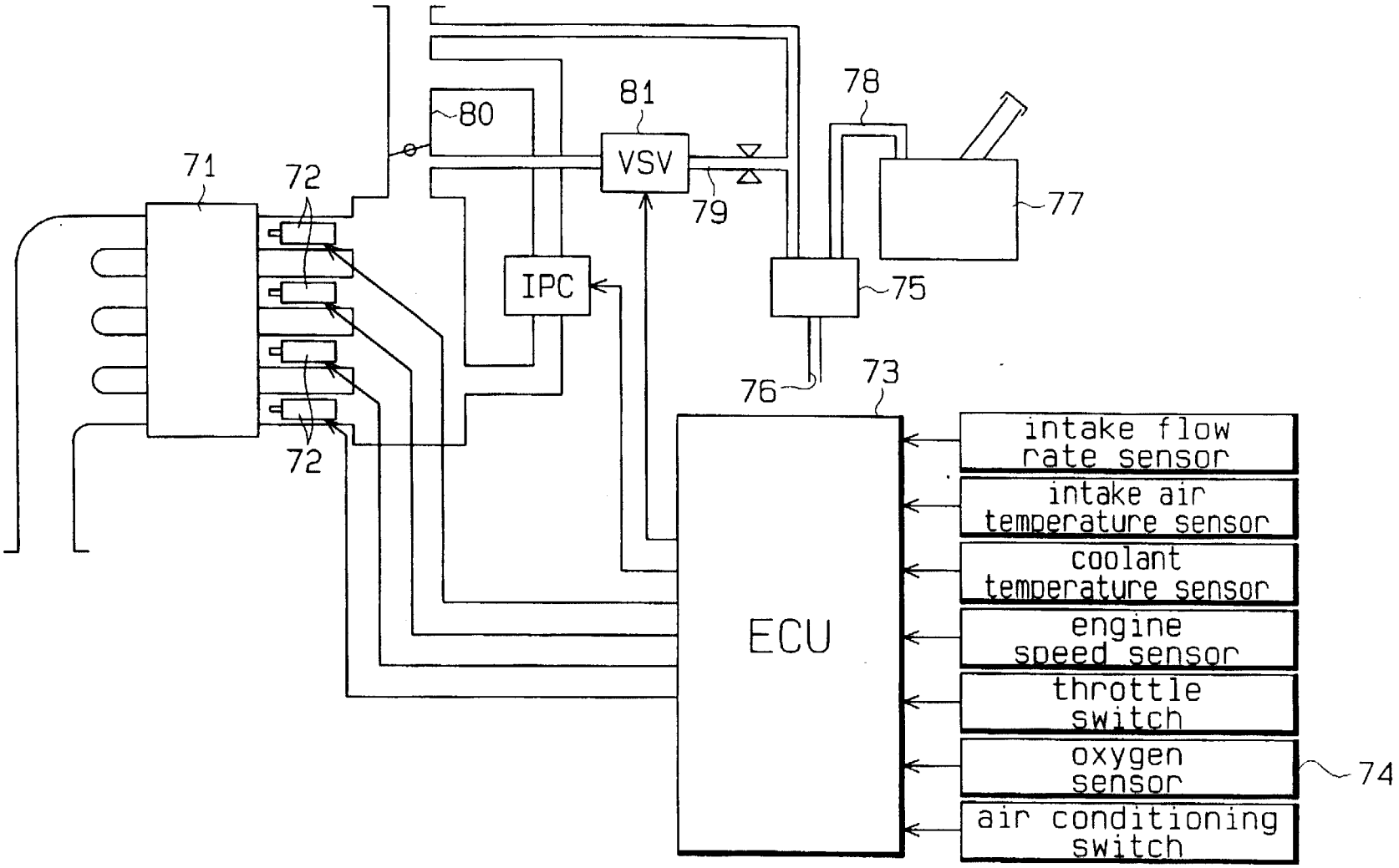
Fig.8(Prior Art)
FIG. 8 is a schematic structural diagram of a conventional air-fuel ratio control apparatus.

FIG. 7 presents the flowchart that illustrates a "fuel injection control routine" for controlling the fuel injection from each injector 7. The ECU 51 periodically executes this routine at predetermined intervals.

In step 400, the ECU 51 calculates a load value GN equivalent to the load of the engine 8, based on the intake flow rate Q and the engine speed NE, respectively detected by the sensors 43 and 45.

In step 410, the ECU 51 calculates a temperature compensation value KT based on the intake air temperature THA and coolant temperature THW, respectively detected by the sensors 42 and 44.

In step 420, the ECU 51 calculates the amount of fuel to be injected at present, TAU, from the following equation (6) based on the air-fuel ratio compensation value FAF, the currently calculated load value GN, the temperature compensation value KT, the purge density learned values FGPGC and FGPGT, and other parameters.

$$TAU=KI\times GN\times KT\times(FAF+FGPGC\times PGR+(FGPGT/(Q\times PGR))) \quad (6)$$

According to this equation (6), the air-fuel ratio compensation value FAF is reflected on the computation of the fuel injection amount TAU. Therefore, the fuel injection amount TAU, which permits the air-fuel ratio of the air-fuel mixture to become the target air-fuel ratio, is obtained. Further, the purge density learned values FGPGC and FGPGT are reflected in the computation of the fuel injection amount TAU, so that the fuel injection amount TAU reflecting the presence or absence of the fuel vapor to be added to the air-fuel mixture is obtained.

In step 430, the ECU 51 controls each injector 7 based on the currently learned fuel injection amount TAU. The amount of fuel to be supplied to the engine 8 is controlled accordingly.

According to the structure of this embodiment, as discussed above, the ECU 51 controls the fuel injection amount TAU injected from each injector 7 based on the running condition of the engine 8 and the value of the oxygen concentration Ox such that the air-fuel ratio of the air-fuel mixture to be supplied to the engine 8 becomes the target air-fuel ratio. When the fuel vapor produced in the tank 1 is purged into the intake passage 10 from the canister 14, the ECU 51 learns the purge density learned values FGPGC, and FGPGT associated with the fuel vapor that is to be added to the air-fuel mixture, based on the deviation from the air-fuel ratio compensation value FAF. At the time of calculating the fuel injection amount TAU, the ECU 51 compensates that amount TAU based on the purge density learned values FGPGC and FGPGT.

Even when fuel vapor is added to the actual air-fuel mixture (which contains the fuel that is supplied from each injector 7), therefore, the air-fuel ratio of the air-fuel mixture is properly adjusted to be the target air-fuel ratio in consideration of that additional fuel component. In this sense, it is possible to improve the precision in controlling the air-fuel ratio in the engine 8 where the fuel vapor produced in the tank 1 is purged into the intake passage 10 via the canister 14.

When determining that there is no flow of fuel vapor toward the canister 14 from the tank 1, the ECU 51 specifies the learned value then as the purge density learned value FGPGC on the canister side. When determining that there is a flow of fuel vapor toward the canister 14 from the tank 1, on the other hand, the ECU 51 specifies the learned value then as the purge density learned value FGPGT on the tank side.

In general, the density of the fuel vapor that is temporarily adsorbed to the adsorbent 15 and then separated therefrom to be indirectly purged into the intake passage 10 is nearly constant regardless of the amount of air that is supplied to the canister 14 from the first control valve 16. The amount of fuel vapor flowing into the canister 14 from the tank 1 is nearly constant. Therefore, the density of the fuel vapor directly purged into the intake passage 10 from the canister 14 without being adsorbed to the adsorbent 15 is inversely proportional to the amount of air supplied to the canister 14 from the first control valve 16.

In view of the above, the ECU 51 compensates the purge density learned values FGPGC and FFPGT based on the difference between those learned values FGPGC and FGPGT, i e., in accordance with the learned values FGPGC and FGPGT, the density conditions of which differ from each other. In other words, the ECU 51 compensates the learned values FGPGC and FGPGT in accordance with the purge density characteristics, which differ between direct purging of fuel vapor and indirect purging of fuel vapor. The ECU 51 reflects those learned values FGFGC and FGPGT on the air-fuel ratio control.

Even if the density condition for fuel vapor to be purged varies depending on whether direct purging or indirect purging occurs, the learned values FGPGC and FGPGT, which are used in compensating the air-fuel ratio, are optimized according to the difference. Accordingly, the adjustment of the air-fuel ratio with the additional fuel vapor taken into consideration is improved. It is thus possible to adjust the air-fuel ratio at a higher precision as compared with the case where the air-fuel ratio of the air-fuel mixture is compensated in accordance with specific learned values, which are determined simply in consideration of fuel vapor to be added to the air-fuel mixture.

According to the structure of this embodiment, learning of the learned values FGPGC and FGPGT is performed based on the deviation of the air-fuel ratio compensation value FAF from the reference value of "1.0". Even when the purge time for fuel vapor becomes longer, therefore, the learned values FGPGC and FGPGT do not become excessively large or small. In this sense, it is unnecessary to set the upper limits and lower limits of the learned values FGPGC and FGPGT.

Although only one embodiment of the present invention has been described herein, it should be apparent to those skilled in the art that the present invention may be embodied in many other specific forms without departing from the spirit or scope of the invention. Particularly, it should be understood that this invention may be embodied in the following forms.

In the disclosed embodiment, the pressure sensor 41 is used to detect the flow of fuel vapor toward the canister 14 from the tank 1. As an alternative, the flow rate sensor for detecting the flow of fuel vapor may be used to detect the flow of fuel vapor toward the canister 14 from the tank 1.

Although the canister 14 in use has the two control valves 16 and 18 in the illustrated embodiment, those valves 16 and 18 may be omitted in which case a hole communicating the atmospheric air is formed in the canister 14. In this modification, air is introduced into the canister 14 from this air hole.

Therefore, the present examples and embodiment are to be considered as illustrative and not restrictive and the invention is not to be limited to the details given herein, but may be modified within the scope of the appended claims.

What is claimed is:

1. An air-fuel ratio control apparatus for an engine that burns a flammable mixture of air, which flows through an air intake passage, and fuel, which is supplied from a fuel tank by a fuel supplying means, said apparatus comprising:

a canister, wherein the canister receives fuel vapor generated in the fuel tank and discharges the fuel vapor into the mixture, wherein the canister incorporates an absorbent and includes an air inlet, and wherein tho absorbent is able to absorb the fuel vapor received by the canister, and wherein the air inlet allows air to flow into the canister when the fuel vapor is discharged from the canister;

density detecting means for detecting density of oxygen in the mixture;

control means for controlling an amount of fuel supplied to the engine from the fuel supplying means to coincide an air-fuel ratio of the mixture with a target air-fuel ratio based on a operating condition of the engine and the detected density of the oxygen;

flow detecting means for detecting fuel vapor flow into the canister from the fuel tank;

a first learning means for learning the density of the fuel vapor added to the mixture as a first density related to fuel vapor that is temporarily absorbed to the absorbent and then is separated therefrom to be discharged from the canister when fuel vapor flow into the canister from the fuel tank is not detected;

a second learning means for learning the density of the fuel vapor added to the mixture as a second density related to fuel vapor that is discharged from the canister without being absorbed to the absorbent when the fuel vapor flow into the canister from the fuel tank is detected; and correcting means for correcting the controlled fuel amount in accordance with a difference between the learned first density and the learned second density.

2. The apparatus according to claim 1, wherein said first density learned by the first learning means is defined as a value per a supply ratio of fuel vapor to be added to the mixture, wherein said second density learned by the second learning means is defined as a value per a reciprocal of fuel vapor amount to be added to the mixture.

3. The apparatus according to claim 1, wherein said control means calculates a correction value for the air-fuel ratio, which is used in correcting the controlled fuel amount to match the air-fuel ratio of the mixture with the target air-fuel ratio, and wherein said first learning means and the second learning means learn the density of the fuel vapor based on a deviation of the air-fuel ratio compensation value from a predetermined reference value.

4. An air-fuel ratio control apparatus for an engine that burns a flammable mixture of air, which flows through an air intake passage, and fuel, which is supplied from a fuel tank by a fuel supplying means, said apparatus comprising:

a canister, wherein the canister receives fuel vapor generated in the fuel tank and discharges the fuel vapor into the mixture, wherein the canister incorporates an absorbent and includes an air inlet, and wherein the absorbent is able to absorb the fuel vapor received by the canister, and wherein the air inlet allows air to flow into the canister when the fuel vapor is discharged from the canister;

operating condition detecting means for detecting an operating condition of the engine;

density detecting means for detecting density of oxygen in the mixture;

control means for controlling an amount of fuel supplied to the engine from the fuel supplying means to coincide an air-fuel ratio of the mixture with a target air-fuel ratio based on the detected operating condition and the detected density of the oxygen;

learning means for learning the density of the fuel vapor added to the mixture based on the controlled fuel amount and the detected density of the oxygen when the fuel vapor is discharged from the canister;

fuel correcting means for correcting the controlled fuel amount based on the learned density;

flow detecting means for detecting fuel vapor flow into the canister from the fuel tank;

a first specifying means for specifying the learned density as a first density related to fuel vapor that is temporarily absorbed to the absorbent and then is separated therefrom to be discharged from the canister when fuel vapor flow into the canister from the fuel tank is not detected;

a second specifying means for specifying the learned density as a second density related to fuel vapor that is discharged from the canister without being absorbed to the absorbent when the fuel vapor flow into the canister from the fuel tank is detected; and density correcting means for correcting the learned density in accordance with a difference between the specified first density and the specified second density.

5. The apparatus according to claim 4, wherein said first density specified by the first specifying means is defined as a value per a supply ratio of fuel vapor to be added to the mixture, wherein said second density specified by the second specifying means is defined as a value per a reciprocal of fuel vapor amount to be added to the mixture.

6. The apparatus according to claim 4, wherein said control means calculates a correction value for the air-fuel ratio, which is used in correcting the controlled fuel amount to match the air-fuel ratio of the mixture with the target air-fuel ratio, and wherein said learning means learns the density of the fuel vapor based on a deviation of the air-fuel ratio compensation value from a predetermined reference value.

7. The apparatus according to claim 5, wherein said control means calculates a correction value for the air-fuel ratio, which is used in correcting of the controlled fuel amount to match the air-fuel ratio of the mixture with the target air-fuel ratio, and wherein said learning means learns the density of the fuel vapor based on a deviation of the air-fuel ratio compensation value from a predetermined reference value.

8. The apparatus according to claim 4 further comprising:

a vapor control valve to control fuel vapor flow into the canister from the fuel tank, wherein the vapor control valve opens in accordance with a difference between the pressure in the fuel tank and the pressure in the canister;

wherein said flow detecting means includes a pressure sensor that detects pressure in the fuel tank and the pressure in the canister with the vapor control valve as a boundary.

9. The apparatus according to claim 8, wherein said first specifying means determines that the fuel vapor flow into the canister from the fuel tank is not detected when the detected pressure in the fuel tank is less than a predetermined value, and wherein said second specifying means determines that the fuel vapor flow is detected when the detected pressure in the tank is equal to or more than the predetermined value.

10. The apparatus according to claim 8, wherein said first specifying means determines that the fuel vapor flow into the canister from the fuel tank is not detected when the detected pressure in the fuel tank is less than a predetermined value, wherein said second specifying means determines that the fuel vapor flow is detected when the detected pressure in the tank is equal to or more than the predetermined value and the detected pressure on the tank side oscillates.

11. The apparatus according to claim 4, wherein said mixture is combusted in the engine and exhaust gas produced during the combustion is emitted from the engine, and wherein said density detecting means includes a oxygen sensor to detect the oxygen concentration of the exhaust gas as the density of the specific component.

12. The apparatus according to claim 4, wherein said operating condition detecting means includes a first sensor to detect the rotational speed of the engine, a second sensor to detect the air flow rate through the intake passage and a third sensor to detect the temperature of a part of the engine.

13. The apparatus according to claim 4, wherein said control means, said learning means, said fuel correcting means, said first specifying means, said second specifying means and said density correcting means are included in an electronic control unit having an input signal circuit, at least one memory, an operation circuit and an output signal circuit.

14. The apparatus according to claim 4, wherein said air inlet includes a check valve, which allows air to be drawn into the canister when pressure in the canister is less than atmospheric pressure and prevents flow of gas in the opposite direction.

15. An air-fuel ratio control apparatus for an engine, wherein said engine draws a flammable mixture of air and fuel, such that the air flows through an air intake passage, wherein the fuel is stored in a fuel tank and is injected by at least one injector, and wherein the mixture is combusted in the engine and exhaust gas produced during the combustion is emitted from the engine, said apparatus comprising:

a canister to collect fuel vapor generated in the fuel tank and to discharge the fuel vapor, wherein fuel vapor is collected by way of a vapor line, wherein the canister incorporates an absorbent and includes an air inlet, wherein the absorbent may absorb the fuel vapor introduced into the canister, wherein the air inlet includes a check valve that allows air to be drawn into the canister when the pressure in the canister is less than atmospheric pressure and prevents flow of gas in the opposite direction of the drawn air, wherein the check valve allows air to flow into the canister when the fuel vapor is discharged from the canister;

a purge line to purge the fuel vapor into the intake passage from the canister so as to add the fuel vapor to the mixture, wherein the purge line is acted by negative pressure produced in the intake passage to cause the fuel vapor to flow when the engine is operating;

a vapor control valve to adjust the fuel vapor flow into the canister from the fuel tank, wherein the vapor control valve opens in accordance with a difference between the pressure in the fuel tank and the pressure in the canister;

a purge control valve to adjust the fuel vapor flowing through the purge line;

operating condition detecting means for detecting an operating condition of the engine;

a oxygen sensor to detect the oxygen concentration of the exhaust gas from the engine;

fuel control means for controlling a fuel amount injected from the injector to match an air-fuel ratio of the mixture with a target air-fuel ratio based on the detected operating condition and the detected oxygen concentration;

valve control means for controlling the purge control valve to purge the fuel vapor to the intake passage from the canister based on the detected operating condition when the engine is operating;

learning means for learning the density of the fuel vapor added to the mixture based on the controlled fuel amount and the detected oxygen concentration when the fuel vapor is purged into the intake passage;

fuel correcting means for correcting the controlled fuel amount based on the learned density;

flow detecting means for detecting the fuel vapor flow to the canister from the fuel tank;

a first specifying means for specifying the learned density as a first density related to fuel vapor that is temporarily absorbed to the absorbent and then is separated therefrom to be discharged to the purge line from the canister when fuel vapor flow to the canister from the fuel tank is not detected;

a second specifying means for specifying the learned density as a second density related to fuel vapor that is discharged to the purge line from the canister without being absorbed to the absorbent when the fuel vapor flow to the canister from the fuel tank is detected; and density correcting means for correcting the learned density in accordance with a difference between the specified first density and the specified second density.

16. The apparatus according to claim 15, wherein said first density specified by the first specifying means is defined as a value per a supply ratio of fuel vapor to be added to the mixture, wherein said second density specified by the second specifying means is defined as a value per a reciprocal of fuel vapor amount to be added to the mixture.

17. The apparatus according to claim 15, wherein said control means calculates a correction value for the air-fuel ratio, which is used in correcting of the controlled fuel amount to match the air-fuel ratio of the mixture with the target air-fuel ratio, and wherein said learning means learns the density of the fuel vapor based on a deviation of the air-fuel ratio compensation value from a predetermined reference value.

18. The apparatus according to claim 16, wherein said control means calculates a correction value for the air-fuel ratio, which is used in correcting of the controlled fuel amount to match the air-fuel ratio of the mixture with the target air-fuel ratio, and wherein said learning means learns the density of the fuel vapor based on a deviation of the air-fuel ratio compensation value from a predetermined reference value.

19. The apparatus according to claim 15, wherein said flow detecting means includes a pressure sensor, which detects the pressure in the fuel tank and the pressure in the canister with the vapor control valve as a boundary.

20. The apparatus according to claim 19, wherein said first specifying means determines that the fuel vapor flow into the canister from the fuel tank is not detected when the detected pressure in the fuel tank is less than a predetermined value, and wherein said second specifying means determines that the fuel vapor flow is detected when the detected pressure in the tank is equal to or more than the predetermined value and the detected pressure in the tank oscillates.

21. The apparatus according to claim 15, wherein said operating condition detecting means includes a first sensor to detect the rotational speed of the engine, a second sensor to detect the air flow rate through the intake passage and a third sensor to detect the temperature or a part of the engine.

22. The apparatus according to claim 15, wherein said fuel control means, said valve control means, said learning means, said fuel correcting means, said first specifying means, said second specifying means and said density correcting means are included in an electronic control unit having an input signal circuit, at least one memory, an operation circuit and an output signal circuit.

* * * * *

UNITED STATES PATENT AND TRADEMARK OFFICE

CERTIFICATE OF CORRECTION

PATENT NO. : 5,758,631
DATED : June 2, 1998
INVENTOR(S) : Masahiko Teraoka

It is certified that error appears in the above-identified patent and that said Letters Patent is hereby corrected as shown below:

Column 1,
Line 65, change "communicatable" to -- communicable --.

Column 3,
Line 18, change "a operating" to -- an operating --.

Column 6,
Line 18, change "DFG" to -- DPG --.
Line 63, before "determination" delete "is".

Column 8,
Line 6, change "FT" to -- PT --.
Line 16, change "then" to -- than --.
Line 33, change "KFT" to -- KPT --.

Column 10,
Line 25, change "FGFGT" to -- FGPGT --.
Line 46, after "processing" change "," to -- . --.
Line 49, change "tans" to -- tank --.

Column 12,
Line 19, change "FFPGT" to -- FGPGT --.
Line 27, change "FGFGC" to -- FGPGC --.

Column 13,
Line 22, change "a operating" to -- an operating --.

UNITED STATES PATENT AND TRADEMARK OFFICE

CERTIFICATE OF CORRECTION

PATENT NO. : 5,758,631
DATED : June 2, 1998
INVENTOR(S) : Masahiko Teraoka

It is certified that error appears in the above-identified patent and that said Letters Patent is hereby corrected as shown below:

Column 15,
Line 18, change "a oxygen" to -- an oxygen --.

Column 16,
Line 7, change "a oxygen" to -- an oxygen --.

Column 18,
Line 2, change "or" to -- of --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*